US005302927A

United States Patent [19]

Fourche et al.

[11] Patent Number: 5,302,927

[45] Date of Patent: Apr. 12, 1994

[54] SADDLE COIL DEFLECTION WINDING, APPARATUS AND METHOD OF MAKING THEREOF

[75] Inventors: Jean-Pierre Fourche, Marsannay La Cote; Eric Audoux, Aiserey, both of France

[73] Assignee: Videocolor, S.A., Paris, France

[21] Appl. No.: 733,032

[22] Filed: Jul. 22, 1991

[30] Foreign Application Priority Data

Aug. 7, 1990 [EP] European Pat. Off. ..... 90402261.3

[51] Int. Cl.[5] ..... H01F 7/00

[52] U.S. Cl. ..... 335/210; 335/213

[58] Field of Search ..... 313/440; 335/210, 213

[56] References Cited

U.S. PATENT DOCUMENTS

| | | | |
|---|---|---|---|
| 3,518,590 | 6/1970 | Gross et al. . | |
| 3,912,182 | 10/1975 | Ishikawa . | |
| 4,464,643 | 8/1984 | Meershoek | 335/213 |
| 4,713,641 | 12/1987 | Osseyran | 335/213 |
| 5,028,899 | 7/1991 | Seu | 335/210 |
| 5,121,028 | 6/1992 | Milili | 335/213 |
| 5,138,290 | 8/1992 | Togane et al. | 335/210 |

OTHER PUBLICATIONS

U.S. Serial No. 599,555, filed Oct. 18, 1990, Milili et al., Deflection Winding With Spaces On Tabs Intermediate Its Front And Rear Ends.

*Primary Examiner*—Lincoln Donovan

*Attorney, Agent, or Firm*—Joseph S. Tripoli; Joseph J. Laks; Francis A. Davenport

[57] ABSTRACT

Dimples or depressions are formed in a deflection coil for a CRT deflection yoke assembly by inserting a spherically shaped end of a dowel-like pin through a hole in the wall of a female arbor, to protrude into a winding cavity formed between a male arbor and the female arbor of the associated yoke coil winding machine. The pin end is inserted only partially into the cavity, for acting as a deformation in the wall of the female arbor, thereby causing convolutions of wire being wound around the cavity to overly the pin. This creates the desired dimple or depression, and controls the distribution of the wires in that area of the deflection coil.

7 Claims, 5 Drawing Sheets

SADDLE COIL DEFLECTION WINDING, APPARATUS AND METHOD OF MAKING THEREOF

The field of the present invention relates generally to deflection coils for television or similar systems, and more particularly to deflection coils including physical interruptions or changes in the homogeneity of the coil windings for producing a desired magnetic field pattern when current is allowed to flow through the windings, and a method for making the same.

In television and other typical cathode ray tube (CRT) based systems, deflection yoke assemblies including deflection coil windings are mounted on the back outer cone and stem of the CRT. In one typical application, the deflection yoke assembly may include a pair of opposing saddle coil deflection windings proximate the CRT, that is in the innermost portion of the yoke assembly relative to the CRT. The outside portion of the yoke assembly may in a typical application have opposing toroidal windings or deflection coils. In such a typical application, the saddle coils may be driven by the horizontal deflection circuit of a television system, and the toroidal coils driven by the vertical deflection circuitry, for positioning an electron beam at any particular instant in time on the face of the display screen of the CRT. In other typical applications saddle coil windings may also be driven by the vertical deflection circuitry. Other combinations of saddle and toroidal deflection coil windings may be used, depending upon the particular application.

In order to produce the required electromagnetic fields via the flow of current through the deflection coils of the deflection yoke assembly, the windings must be accurately positioned. By way of illustration of the present invention, saddle coil deflection windings are particularly described. A conventional method of manufacturing saddle coils, for example, is to wind the coils in a cavity created between male and female arbors. As is known in the art, the male and female arbors may be held stationery with a flyer mechanism rotating thereabout for winding enamel coated copper wire, for example, within the cavity to form the deflection winding. Contrariwise, the arbors may be rotated, in association with a stationery wire feed mechanism. During the winding process various techniques are used in order to control the distribution of the wire in the winding for obtaining a desired electromagnetic field pattern.

One known apparatus and method for winding a deflection yoke coil is disclosed in Gross et al. U.S. Pat. No. 3,518,590, entitled "Deflection Yoke And Apparatus For Its Fabrication Utilizing A Magnetic Ramming Technique", issued on Jun. 30, 1970. A deflection coil is fabricated on apparatus including a pair of male and female members for providing a cavity therebetween when mated together, with a window block extending between the members for dividing the cavity into identical compartments. A plurality of convolutions of wire are wound into the compartments within the cavity for forming a desired coil configuration.

Ishikawa U.S. Pat. No. 3,912,182, entitled "Apparatus For Winding Saddle-Shaped Deflection Coil", also teaches the use of male and female members that when mated form a cavity therebetween. The deflection coil is wound within the cavity for providing a desired winding configuration for the deflection coil. The male and female members are designed to have particular cross sections at any given point in order to provide the desired winding configuration for the saddle-shaped deflection coil.

An inventive feature of the invention is to provide both an improved deflection yoke coil winding, and an improved apparatus and method for making the same. Still another object of the invention is to provide an improved apparatus and method for making a deflection yoke coil in a manner substantially reducing damage to the windings during manufacture.

With the problems of the prior art in mind, these and other objects of the invention are provided by selectively positioning protrusion means to penetrate into one or more areas within a cavity formed between male and female members of a deflection coil winding apparatus, during the winding of a coil in the cavity, for introducing dimples or depressions into preselected locations on the winding portions, for obtaining a desired shaping of the electromagnetic field produced by the coil when current is passed therethrough. In one embodiment of the invention the protrusion means projects from the surface of the female member into the cavity in a manner for causing the desired dimple or depression to be formed into the deflection coil as it is being wound, in a manner avoiding penetration of the protrusion means through the windings, and at the same time avoiding damage to the enamel of the windings and associated wire proximate the protrusion means.

Figure 1:
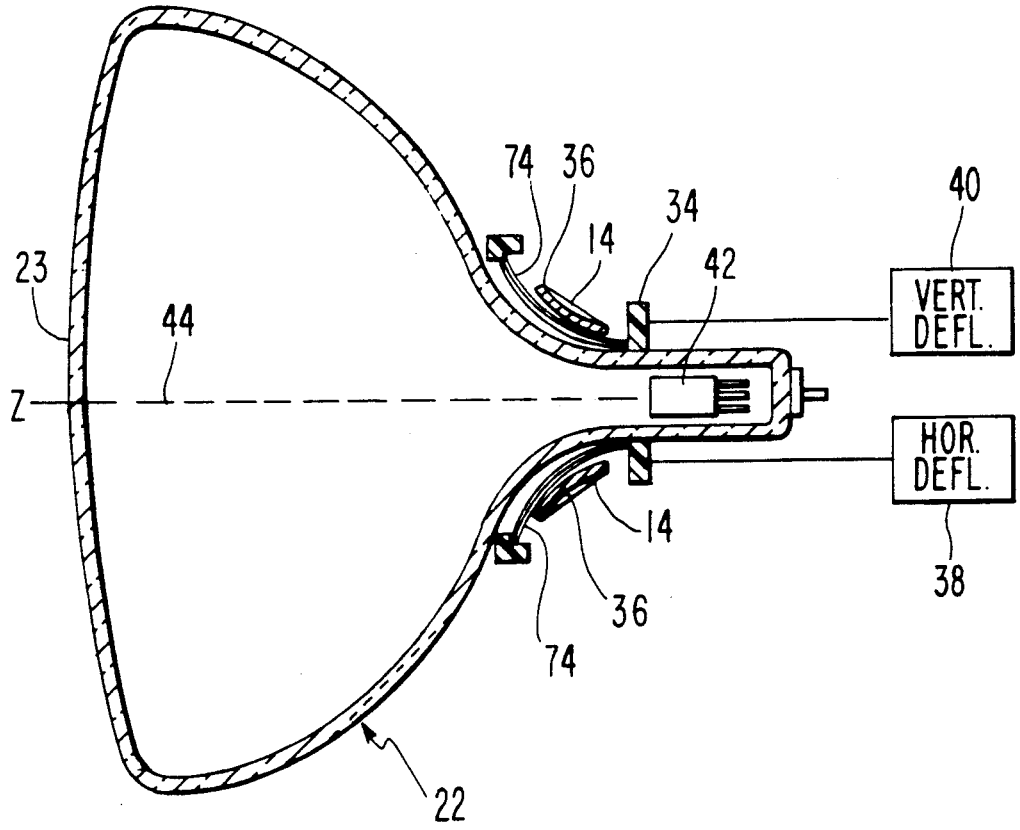
FIG. 1 is a cross sectional view of a deflection coil system mounted upon a CRT, shown in simplified form, including horizontal coils embodying the invention.

In FIG. 1, a simplified cross-sectional drawing is shown for illustrating the positioning of deflection coils relative to a CRT 22. As shown, deflection coils 74 are formed in the shape of saddle windings, whereas coils 14 are toroidal windings, in this example. Also in this example, the toroidal coils 14 are wound around soft magnetic core pieces 36. An insulating liner 34 separates the horizontal and vertical deflection coils.

Deflection coils 74 are driven by horizontal deflection circuit 38, and deflection coils 14 are driven by vertical deflection circuit 40. An electron gun 42 is positioned within CRT 22 for emitting electron beams along the Z axis 44, to strike a luminescent screen 23. The electromagnetic fields produced by the horizontal and vertical deflection coils cause the electron beams to be positioned at a desired spot on the screen 23 of the CRT 22, at any given instant of time.

Figure 2:
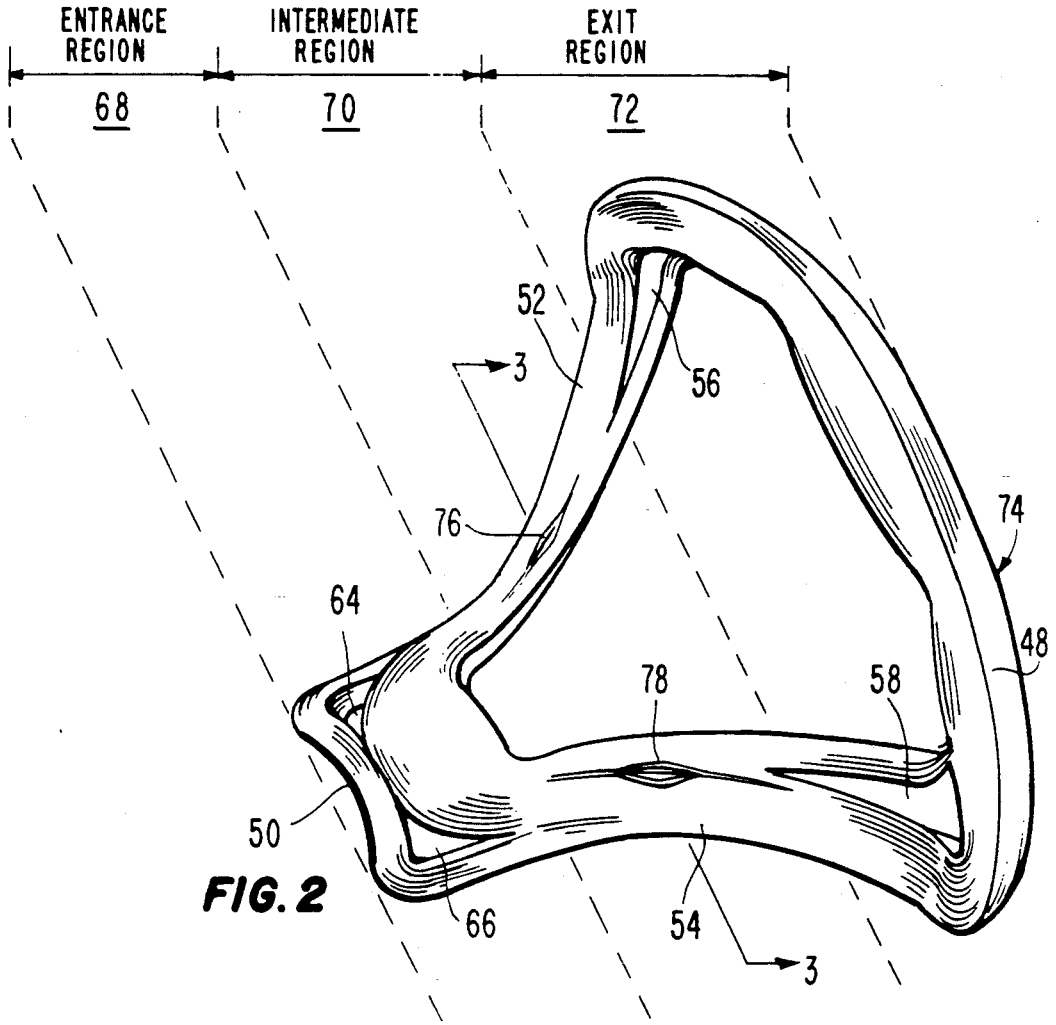
FIG. 2 shows a deflection coil including an embodiment of the invention, as fabricated using a method of the present invention for forming dimples or depressions on selected areas of the surface of the deflection coil winding.

With further reference to FIG. 2, a saddle coil 74, embodying the invention, that could be used as the horizontal deflection coil of FIG. 1, includes front end turns 48, rear end turns 50, flared side members 52 and 54, front end turn apertures or openings 56 and 58, and rear end turn apertures or openings 64 and 66. Note that the apertures or openings 56, 58, 64, and 66, are of a predetermined size and shape, and are purposely located at the positions shown, in this example, for providing control over the shape of the electromagnetic field produced by the saddle winding or coil 46 in different regions thereof, for correcting various errors that would otherwise occur in the positioning of the beams. For example, the field produced in an entrance region 68 is controlled for correcting coma errors that may occur in this region. The field produced in an intermediate region 70 is controlled for correcting convergence errors, and the field produced in the exit region 72 is controlled for correcting geometry errors that occur at the edges of the picture produced on the screen 23 of CRT 22.

In an embodiment of the invention, dimples or depressions 76 and 78 are located in side members 52 and 54, respectively. Note that in this example the depressions 76 and 78 are diamond shaped, but could be otherwise shaped depending upon the application and electromagnetic field shape required in the intermediate region. In this example, dimples or depressions 76 and 78 are mirror images of one another, and are positioned opposite to one another.

Figure 3:
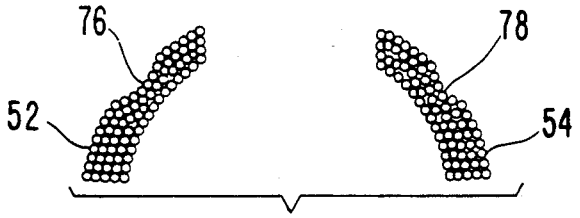
FIG. 3 is a cross sectional view taken on the line 6—6 of FIG. 5, showing typical central portions of the dimples or depressions formed into the deflection coil winding surface by a method of the present invention.

In FIG. 3, a cross section of saddle winding 74 is taken along line 6—6 of FIG. 2. The deflection coil 74 is fabricated in such a way, as will be described below, to provide that the provision of dimples or depressions 76 and 78 does not cause unnecessary crowding or stress on the underlying wires.

Figure 4:
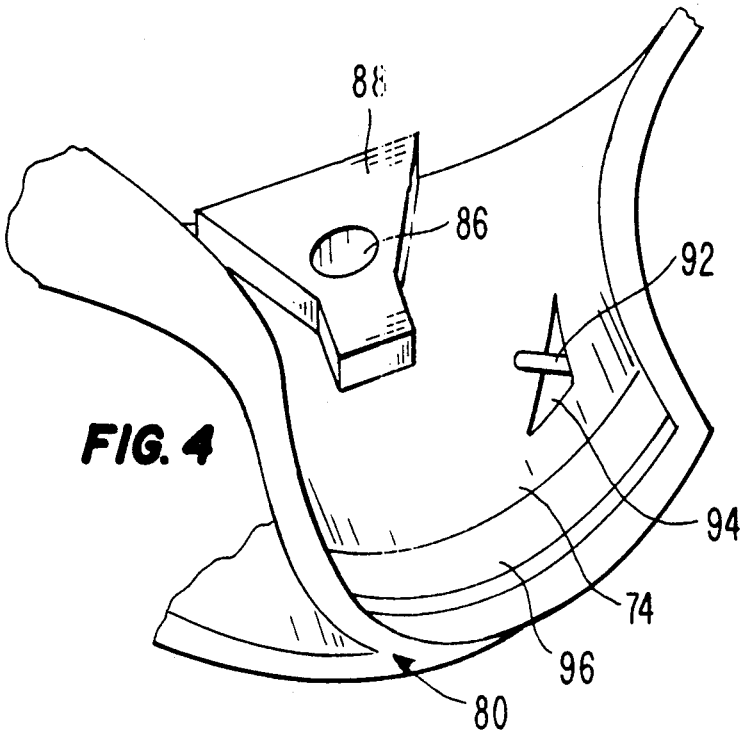
FIG. 4 is a simplified perspective view of a female member or arbor of the apparatus of the present invention, showing a technique for producing spaces or openings at selective locations through the surface of the deflection coil winding as it is being wound.
Figure 5:
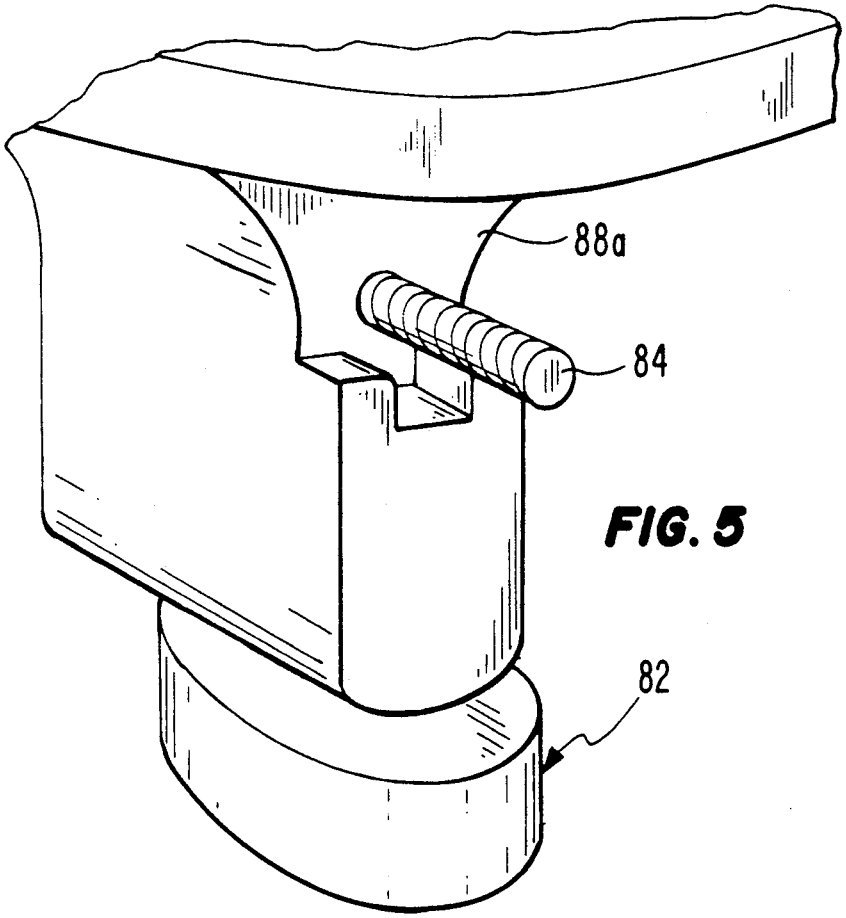
FIG. 5 shows a simplified perspective view of a male member or arbor of the apparatus of the present invention.

An embodiment of a female arbor to produce the saddle coils 74 according to the invention, is a female arbor 80, as shown in FIG. 4. A male arbor 82 is shown in FIG. 5. The arbors 80 and 82 are mated together with a threaded locating screw 84 of male arbor 82 being inserted through a locating hole 86 in an arbor pedestal 88 associated with the female arbor 80, as shown in this example. A nut, not shown in the drawing, is threaded on screw 84 tight against the back of arbor 80. Pedestal 88 fits into a corresponding shaped cavity 88*a* in male arbor 82.

Figure 6:
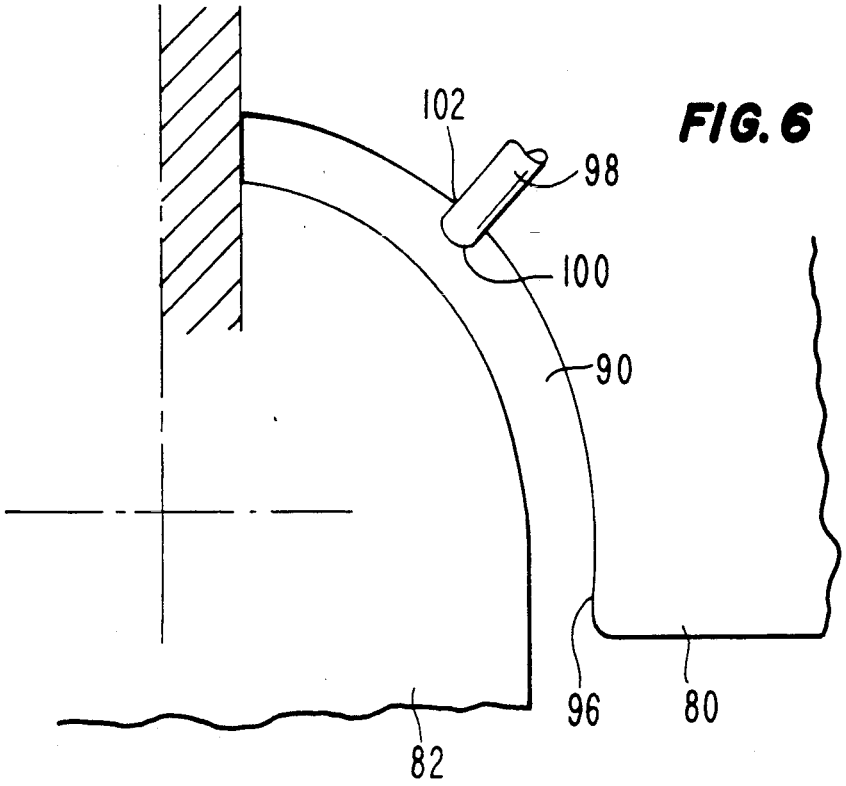
FIG. 6 shows a simplified partial cross sectional view of the apparatus associated with a method of the invention for producing a deflection winding with dimples or depressions at predetermined locations on the winding.

When mated, a cavity 90 is formed between the male and female arbors 80 and 82, respectively, as shown simplistically in FIG. 6. In a conventional manner, a flyer (not shown) is used to wrap wire around and within the cavity 90 between the stationery arbors 80 and 82 to form the saddle coils 74. The various apertures or through holes, as previously described for saddle coils 74, are each formed during the winding process by inserting a pin 92 typically having a relatively pointed tip 94 through a hole 102 (see FIG. 7) in the landing platform or inside bottom portion 96 of female arbor 80. The landing platform 96 receives the wires as they are being wound about the arbors 80 and 82 for forming one of the saddle coils 74. As shown in FIG. 4, the pin 92 is made to protrude substantially across the cavity 90 (see FIG. 6) between the male and female arbors 82, 80, respectively, as the wire is being wound. Typically, the diameter and overall shape of the pin 92, and its angle of entry into the cavity 90 determines the size and shape of the aperture 94 formed at that location in the deflection coil being fabricated. A number of such pins 92 may be utilized for forming apertures at various positions, as desired, in the manufacture of a deflection coil.

The use of pins, such as pin 92 projecting through holes in the inside wall 96 of an arbor 80, provides a means during the winding of the deflection coil to more precisely distribute the wires during the winding process. As indicated above, the use of such pins 92 creates apertures or holes through the deflection coil being wound, while at the same time permitting better control of the position of the associated wires.

It has been found that when such pins are employed in winding a deflection coil to control the distribution of wires in the middle of the arbors (also in the middle of the deflection coil), the associated apertures or holes cause a significant change in the winding distribution and pattern of the associated electromagnetic field produced by the completed deflection coil. Many times, the associated changes are greater than desired, and difficult to control. Also, it has been found that the pins 92 sometimes damage the wire being wound in an associated arbor. Enamel damage may occur during winding of the deflection coil, or in a heating/pressing cycle, during which cycle the arbors are pressed together using conventional techniques to complete formation of the deflection winding. Deflection coils wound as saddle coils are particularly susceptible to wire and/or enamel damage from the use of pins 92, for example.

Figure 7:
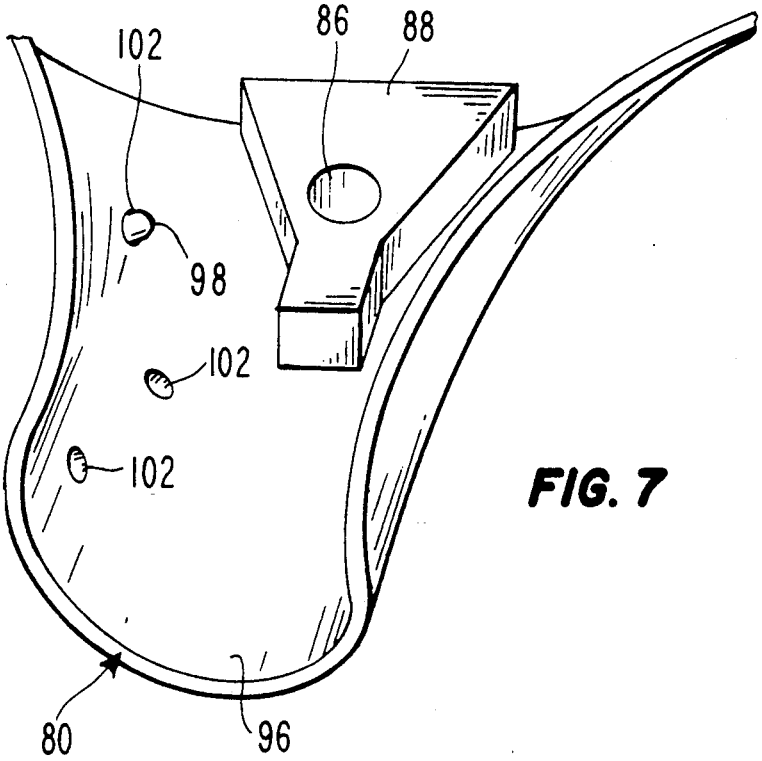
FIG. 7 is a simplified perspective view of a female arbor of one embodiment of the invention, including a hole for permitting a pin or dowel-like rod having a spherically shaped end to protrude into the coil winding portion of the arbor, for providing the apparatus and method for one embodiment of the invention.
Figure 8:
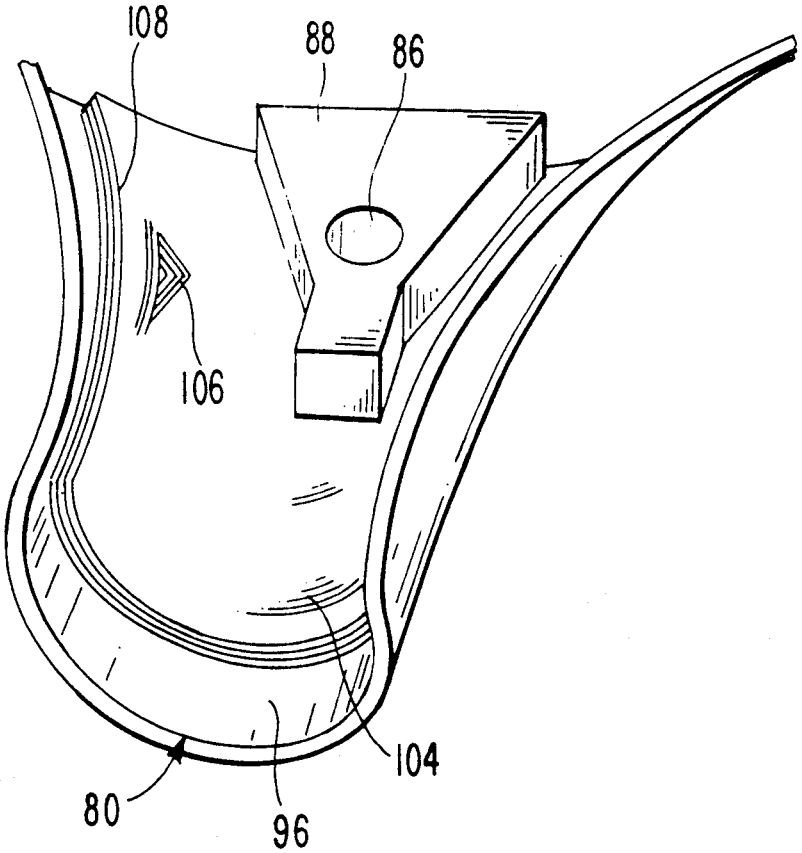
FIG. 8 shows the female arbor of FIG. 7 with a deflection coil winding wound within the arbor, using the method of the present invention for producing a dimple or depression at a predetermined location on the surface of the deflection coil winding.

With reference to FIGS. 6, 7 and 8, in an embodiment of the invention, a pin 98 having a less pointed or spherically shaped head or tip 100 is inserted through a hole 102 in the platform 96 of the female arbor 80 in a manner for causing a depression or dimple, such as 76 and/or 78 of FIG. 2, in the deflection coil being wound. As shown in FIG. 7, the platform 96 of arbor 80 may have a number of through holes 102 at desired locations for permitting pins 98 or pins 92 to be inserted through the holes 102 from the other side of the associated arbor wall, whereby the extent of protrusion of pins into the cavity 90 is controlled for either producing apertures with pins 92, as previously described, or dimples or depressions in the deflection winding in a manner to be described below.

The pins 98 permit control over the distribution of the wires being wound in the cavity for forming a deflection coil, while avoiding the wire and enamel damage sometimes caused through the use of the pins 92 for forming apertures. To create a dimple or depression in the deflection coil winding, for controlling the wire distribution at a given location in the deflection coil while it is being wound, the pin or pins 98 to be utilized are initially retracted for the first winding turn or layer of a deflection coil 104 (see FIG. 8) to be wound on landing platform 96 of arbor 80. Depending on the application, the pin 98 may remain retracted for more than a first turn, wherein the winding apparatus is programmed to cause pin 98 to partially insert at least the spherical head 100 of pin 98 into a desired region where the deflection coil 104 is being wound. The turns necessary to complete the winding of coil 104 are then completed. Note that by so inserting a pin 98 partially into the winding region of arbor 80 or cavity 90, the pin 98 is equivalent to causing, during the winding process, a deformation to be formed within the cavity 90, on platform 96 of arbor 80. In a typical application, one or more pins 98 having a radius ranging from 5.0 millimeters to 6.0 millimeters, with spherical ends 100 thereof of larger radius, provide the forming of diamond shaped dimples or depressions 106, as shown in FIG. 8.

The design of the pins 98, with spherical ends or heads 100, along with the programmed partial insertion thereof into the cavity 90, is accomplished in a manner providing for a soft contact between the end of the pin and the wires being wound over and about the pin 98, or pins 98 at different locations. In this manner, one or more dimples or depressions 106 can be formed into a deflection coil winding 104 during the winding of the wires thereof, as illustrated in this example. However, if the pins 98 are made to protrude far enough into cavity 90, they could cause an aperture to be formed instead of a depression or dimple in the winding. In the illustrated embodiment, the pins 98 are made to protrude in such a manner that their spherical tips 100 provide a soft contact therebetween with the wire being wound into the deflection coil, as previously mentioned. Such soft contact, resulting from control of the extent of the insertion of pin 98 into cavity 90, and the spherical shape of the pin end 100 substantially eliminates any damage to the wire or the enamel on the wire during the deflection coil winding process. This illustrated embodiment of the invention is particularly applicable in the winding of saddle coils.

In the areas including the dimples or depressions 106, the wires of the deflection coil winding 104 are of lesser density than in other areas of the deflection coil 104, thereby providing control over the shaping of the electromagnetic field produced by the deflection coil 104 when current is passed therethrough. The previously illustrated apertures or voids can be used to accomplish a similar result. However, as previously mentioned, much more precise control is provided over such ultimate field shaping through the use of the dimples or depressions 106, rather than through the use of the aforesaid apertures. However, in certain applications it may be advantageous to utilize a combination of apertures and dimples or depressions.

Note also that during the winding of a deflection coil 104, the apparatus can be programmed for variably changing the positioning of one or more pins 98 in the winding path, for obtaining a desired distribution of wires about such pins 98, rather than inserting the pins 98 from a retractive position to a fixed position within the winding path, for example. Also, a combination of pins 98 and pins 92 may be used in other applications, in the manner previously illustrated, for forming both apertures and dimples or depressions at predetermined locations on the outside portions of side members of deflection coil windings, such as 104, during the fabrication process.

In FIG. 8, a female arbor 80 is shown with a substantially completed deflection coil winding 104 having a dimple or depression 106 formed at a desired location in the flared side portion 108 of the deflection coil 104. In this manner, control of the distribution of the wires throughout the deflection coil 104 can be obtained, and particularly for the intermediate side portions thereof.

Although various embodiments of the present invention have been shown and described herein, they are not meant to be limiting. For example, instead of selectively inserting one or more pins 98 through holes 102 in platform 96 of the female arbor 80, for creating dimples or depressions in the deflection coil during its fabrication, permanent deformations can be formed in the platform 96 to accomplish the same result. Interchangeable platforms 96 with different patterns of deformations could be provided to accommodate making different configurations of deflection coils, for example. The pins could also be introduced in male arbor 82 so as to create dimples in the interior contour of the coil winding.

What is claimed is:

1. A deflection yoke coil of a deflection yoke assembly for a cathode ray tube, comprising:

a plurality of convolutions of wire formed into a shape having opposing side members with a window opening therebetween, said coil including front end turns and rear end turns, each wound in a direction generally transverse to said side members; and at least one depression or dimple of predetermined shape being formed in an intermediate region of each one of said side members, for controlling the distribution of said wire proximate said depressions.

2. The deflection yoke coil of claim 1, further including at least one front end aperture being formed through each one of said side members proximate associated front end turns, respectively.

3. The deflection yoke coil of claim 1, further including at least one rear end aperture being formed through each one of said side members proximate associated rear end turns, respectively.

4. The deflection yoke coil of claim 1, wherein said side members are outwardly flaring from said rear end turns toward said front end turns.

5. The deflection yoke coil of claim 1, wherein each one of said depressions in said side members opposes a like positioned and shaped depression in the other of said side members.

6. Apparatus including a saddle-shaped coil in a deflection yoke assembly located on a cathode ray tube having a substantially cylindrical neck section housing an electron gun at one end, and flaring outward sections from the other end of said neck section to terminate at a frontmost luminescent screen, said coil comprising:

a plurality of convolutions of wire, each convolution including a side member disposed on opposite longitudinal sides of a window opening of said coil, and extending generally longitudinally of said tube while substantially conforming to said cylindrical neck and flared sections of said cathode ray tube, and front end turns and rear end turns extending generally transversely of said cathode ray tube in connecting said longitudinal side members, said side members being concave and flaring outward from said rear end turns to said front end turns; and said side members each include a plurality of opposing dimples or depressions in wire portions away from said cathode ray tube, said depressions in one of said side members each opposing a like positioned and shaped depression in the other side members of said coil.

7. The saddle coil of claim 6, further including a plurality of rear end turn apertures and front end turn apertures through each one of said side members proximate said rear and front ends of said coil, respectively, said apertures through one side member opposing a substantially similarly shaped and located aperture through the other side member.

* * * * *